US009422872B2

(12) United States Patent
Hiyoshi et al.

(10) Patent No.: US 9,422,872 B2
(45) Date of Patent: Aug. 23, 2016

(54) VARIABLE COMPRESSION RATIO INTERNAL COMBUSTION ENGINE

(71) Applicant: NISSAN MOTOR CO., LTD., Yokohama-shi, Kanagawa (JP)

(72) Inventors: Ryosuke Hiyoshi, Isehara (JP); Yoshiaki Tanaka, Fujisawa (JP); Yusuke Takagi, Hadano (JP)

(73) Assignee: NISSAN MOTOR CO., LTD., Yokohama-shi, Kanagawa (JP)

( * ) Notice: Subject to any disclaimer, the term of this patent is extended or adjusted under 35 U.S.C. 154(b) by 184 days.

(21) Appl. No.: 14/356,469

(22) PCT Filed: Oct. 9, 2012

(86) PCT No.: PCT/JP2012/076114
§ 371 (c)(1),
(2) Date: May 6, 2014

(87) PCT Pub. No.: WO2013/080674
PCT Pub. Date: Jun. 6, 2013

(65) Prior Publication Data

US 2014/0290625 A1 Oct. 2, 2014

(30) Foreign Application Priority Data

Nov. 29, 2011 (JP) ..... 2011-259752

(51) Int. Cl.
*F01M 9/10* (2006.01)
*F02D 15/00* (2006.01)
*F02B 75/32* (2006.01)
(Continued)

(52) U.S. Cl.
CPC ..... *F02D 15/00* (2013.01); *F01M 9/10* (2013.01); *F01M 11/02* (2013.01); *F02B 75/048* (2013.01); *F02B 75/32* (2013.01); *F02D 15/02* (2013.01);
(Continued)

(58) Field of Classification Search
CPC ..... F02D 15/00; F01M 9/10
USPC ..... 123/48 R
See application file for complete search history.

(56) References Cited

U.S. PATENT DOCUMENTS 5,329,893 A * 7/1994 Drangel ..... F02B 75/041 123/195 C
6,920,847 B2 7/2005 Hiyoshi et al.

FOREIGN PATENT DOCUMENTS

JP 2002-122013 A 4/2002
JP 2004-257254 A 9/2004
(Continued)

*Primary Examiner* — Hung Q Nguyen
*Assistant Examiner* — Kevin Lathers
(74) *Attorney, Agent, or Firm* — Drinker Biddle & Reath LLP

(57) ABSTRACT

It is an object to increase the reliability and durability by minimizing mixing/entry of foreign matter (contaminants) into a speed reducer. The speed reducer is provided for reducing rotation of an actuator of a variable compression ratio mechanism and for transmitting the reduced rotation to a control shaft of the variable compression ratio mechanism. The actuator and the speed reducer are attached to a sidewall of an engine main body with a housing therebetween. An oil filter, which removes contaminants from within lubricating oil, is attached to the housing with an oil-passage-forming body therebetween. A portion of the lubricating oil supplied from the oil filter immediately after having been filter-purified is supplied via a bypass oil passage, formed in the oil-passage-forming body and the housing, into a speed-reducer accommodation chamber of the housing.

14 Claims, 14 Drawing Sheets

(51) Int. Cl.

| | |
|---|---|
| ***F02D 15/02*** | (2006.01) |
| ***F02B 75/04*** | (2006.01) |
| ***F01M 11/02*** | (2006.01) |
| *F01M 5/00* | (2006.01) |
| *F01M 11/03* | (2006.01) |

(52) U.S. Cl.
CPC ..... *F01M 5/002* (2013.01); *F01M 2011/021* (2013.01); *F01M 2011/033* (2013.01)

(56) References Cited

FOREIGN PATENT DOCUMENTS

| | | |
|---|---|---|
| JP | 2006-177270 | 7/2006 |
| JP | 2010-112279 A | 5/2010 |
| JP | 2010-151088 A | 7/2010 |
| JP | 2011-169152 A | 9/2011 |

* cited by examiner

EMBODIMENT

COMPARATIVE EXAMPLE

VARIABLE COMPRESSION RATIO INTERNAL COMBUSTION ENGINE

TECHNICAL FIELD

The present invention relates to a variable compression ratio internal combustion engine equipped with a variable compression ratio mechanism capable of changing an engine compression ratio.

BACKGROUND ART

The applicants of the present application have conventionally proposed a variable compression ratio mechanism that can change an engine compression ratio, utilizing a multi-link piston-crank mechanism (for instance, see Patent document 1 described later). Such a variable compression ratio mechanism is configured to control an engine compression ratio depending on an engine operating condition by changing a rotational position of a control shaft by means of an actuator such as a motor.

CITATION LIST

Patent Literature

Patent document 1: Japanese patent provisional publication No. 2004-257254 (A)

SUMMARY OF INVENTION

Technical Problem

A large combustion load and/or a large inertia load repeatedly acts on the control shaft of the variable compression ratio mechanism via the multi-link mechanism, and thus the actuator, which changes and holds the rotational position of the control shaft, requires a very large holding force as well as a very large driving force. Therefore, the applicants are studying that a speed reducer, such as a harmonic-drive speed reducer, which can provide a high reduction ratio, is interposed between the actuator and the control shaft, and hence the driving force and the holding force of the actuator can be both decreased by reducing rotation of the actuator, (i.e., by multiplying torque from the actuator) by means of the speed reducer and by transmitting the reduced rotation (the multiplied torque) to the control shaft.

Accordingly, in an actuator mounting structure in which an actuator and a speed reducer of a variable compression ratio mechanism are attached to a sidewall of an engine main body with a housing therebetween, it is an object of the invention to suppress undesirable mixing/entry of foreign matter (debris and contaminants) into the speed reducer and to enhance a lubricating performance.

Solution to Problem

In a variable compression ratio internal combustion engine having a variable compression ratio mechanism that enables an engine compression ratio to be changed depending on a rotational position of a control shaft driven by an actuator and a speed reducer that reduces rotation of the actuator and transmits the reduced rotation to the control shaft, the actuator and the speed reducer being attached to a sidewall of an engine main body with a housing therebetween, an oil filter, which removes contaminants from within lubricating oil, is attached to the housing, and a bypass oil passage, which supplies a portion of lubricating oil after having passed through the oil filter to lubricated parts of the speed reducer installed in the housing, is also provided.

Advantageous Effects of Invention

According to the invention, an oil filter is attached to a housing, and a bypass oil passage, which supplies a portion of lubricating oil after having passed through the oil filter to lubricated parts of a speed reducer configured in the housing, is also provided. Therefore, it is possible to feed a portion of lubricating oil, purified by means of the oil filter, through the use of the shortest route via the bypass oil passage to the lubricated parts of the speed reducer, thereby enhancing a lubricating performance and minimizing mixing/entry of foreign matter (debris/contaminants) into the speed reducer, and thus increasing the reliability and durability of the speed reducer.

BRIEF DESCRIPTION OF DRAWINGS

FIG. 5(A) is a perspective view illustrating an auxiliary shaft and lever sub-assembly of the embodiment, whereas

FIG. 11(A) is an explanatory view illustrating an oil-level height position of the auxiliary shaft at a low compression ratio, whereas

FIG. 17(A) is an explanatory view illustrating a bearing sleeve of a reference example, whereas

DESCRIPTION OF EMBODIMENTS

Figure 1:
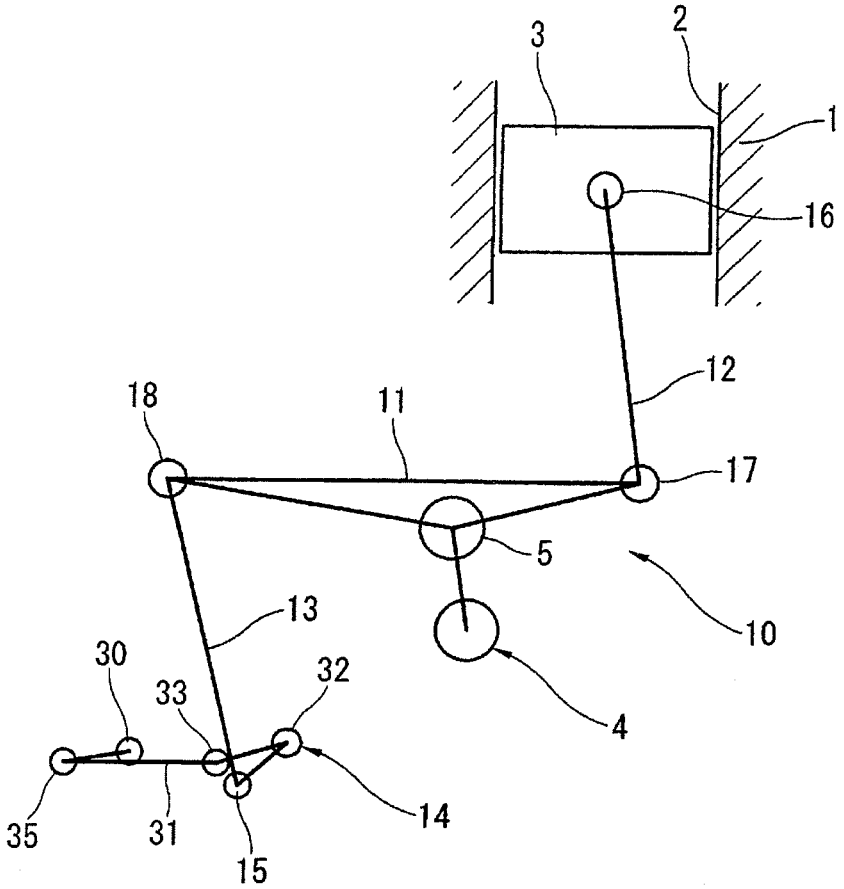
FIG. 1 is a schematic diagram illustrating the configuration of one example of a variable compression ratio mechanism related to the invention.

Preferred embodiments of the invention are hereinafter described in reference to the drawings. A variable compression ratio mechanism, which utilizes a multi-link piston-crank mechanism, is hereunder explained in reference to FIG. 1. By the way, this mechanism is publicly known as set forth in Japanese patent provisional publication No. 2004-257254 (A), and thus its construction is hereunder described briefly.

A piston 3 of each engine cylinder is installed in a cylinder block 1, which constructs a part of an internal combustion engine, and slidably fitted into a cylinder 2. Also, a crankshaft 4 is rotatably supported by the cylinder block. A variable compression ratio mechanism 10 has a lower link 11, an upper link 12, a control shaft 14, a control eccentric shaft 15, and a control link 13. The lower link is rotatably installed on a crankpin 5 of crankshaft 4. The upper link mechanically links the lower link 11 to the piston 3. The control shaft is rotatably supported on the engine main body side, such as the cylinder block 1. The control eccentric shaft is arranged eccentrically with respect to the control shaft 14. The control link mechanically links the control eccentric shaft 15 to the lower link 11. Piston 3 and the upper end of upper link 12 are connected together via a piston pin 16 so as to permit relative rotation. The lower end of upper link 12 and lower link 11 are connected together via a first connecting pin 17. The upper end of control link 13 and lower link 11 are connected together via a second connecting pin 18. The lower end of control link 13 is rotatably installed on the control eccentric shaft 15.

A variable compression ratio motor 20 (for instance, see FIG. 2), serving as an actuator, is connected to the control shaft 14 via a speed reducer 21 (described later). A piston stroke characteristic, including a piston top dead center (TDC) position and a piston bottom dead center (BDC) position, changes with an attitude change of lower link 11, created by changing a rotational position of control shaft 14 by the variable compression ratio motor 20. Hence, an engine compression ratio changes. Thus, it is possible to control the engine compression ratio depending on an engine operating condition by controlling the drive (the operation) of variable compression ratio motor 20 by a control part (not shown). By the way, the actuator is not limited to such an electric motor 20, but a hydraulically-operated actuator may be used.

Figure 2:
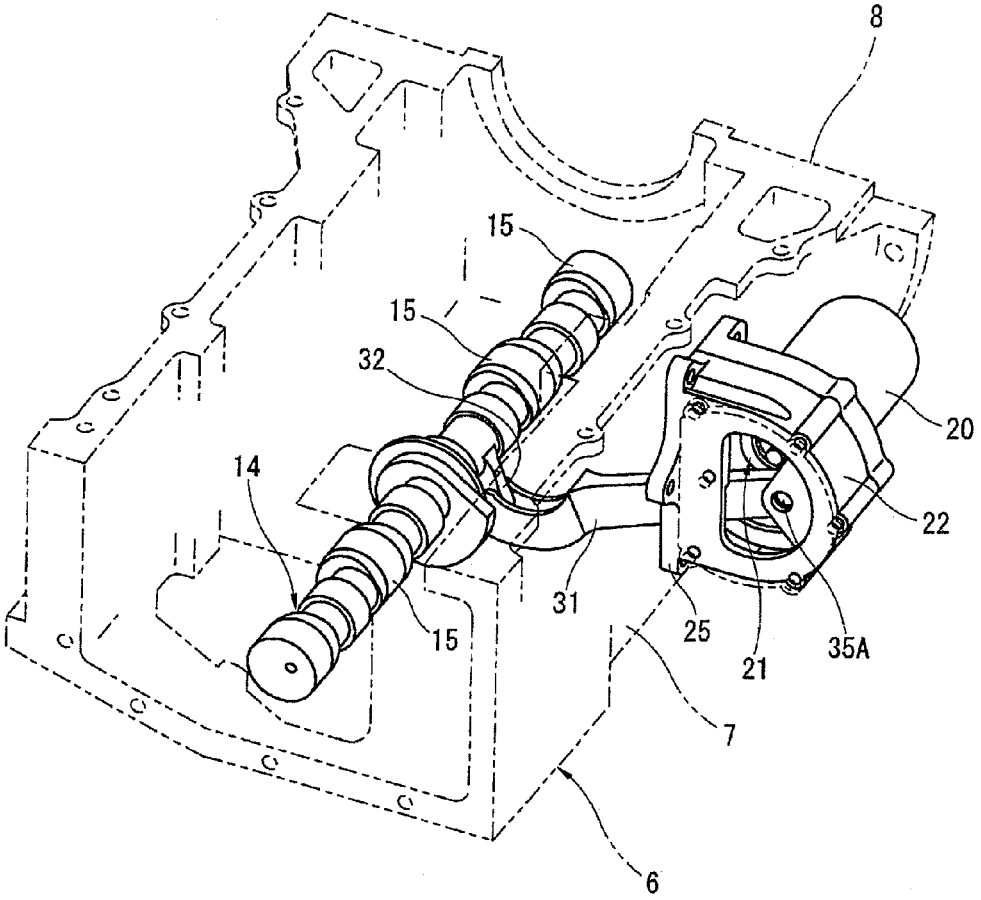
FIG. 2 is a perspective view illustrating a variable compression ratio internal combustion engine according to one embodiment of the invention.
Figure 3:
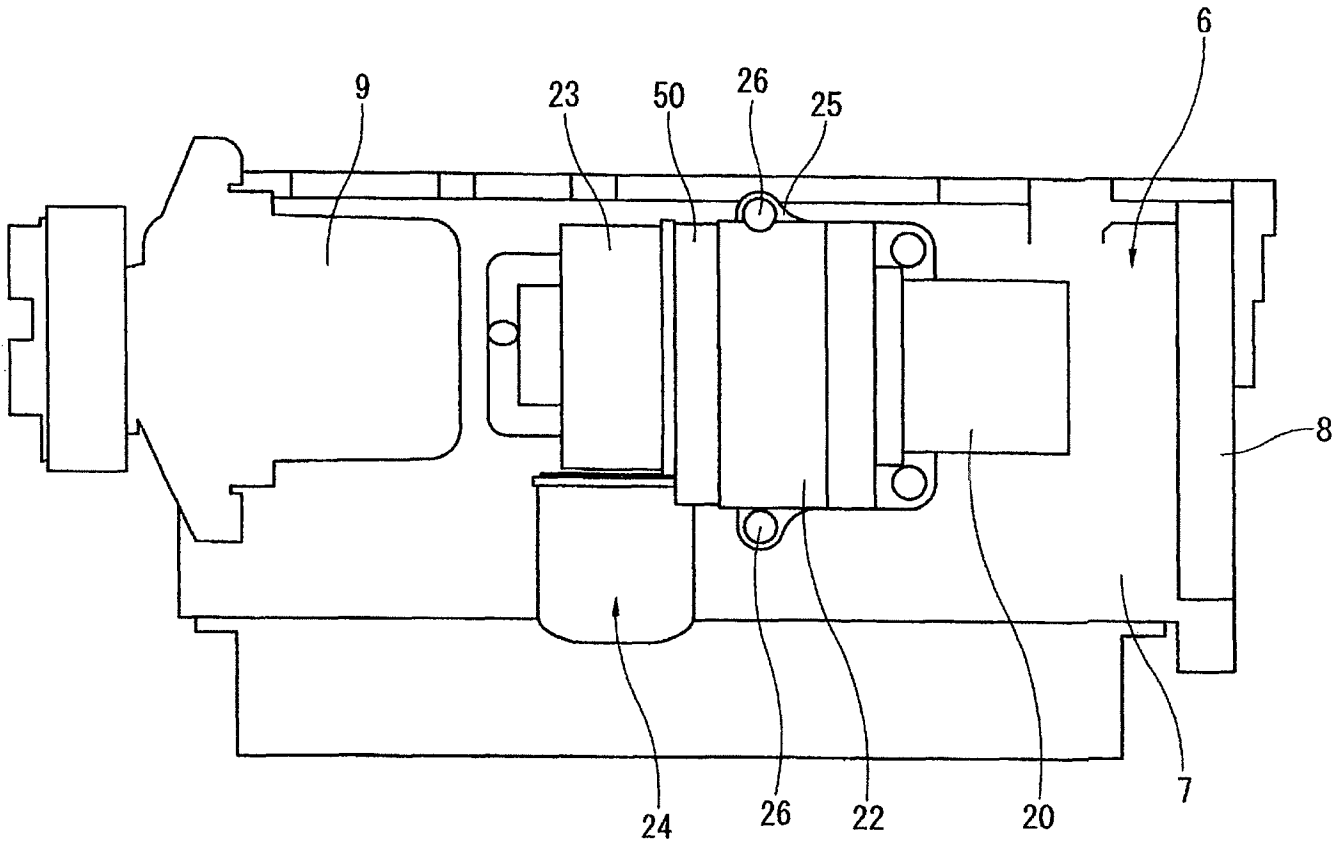
FIG. 3 is a side view illustrating the intake side of the internal combustion engine of the embodiment.

Referring to FIGS. 2-3, control shaft 14 is rotatably housed in the engine main body, constructed by the cylinder block 1 and an oil pan upper 6 or the like. On the other hand, speed reducer 21 and variable compression ratio motor 20 are attached to an outside wall of oil pan upper 6, constructing a part of the engine main body, i.e., an intake-side sidewall 7 for details, with a housing 22, in which speed reducer 21 is housed. In addition to the variable compression ratio motor 20, an oil cooler 23, which cools lubricating oil, is further attached to the housing 22. Still further, an oil filter 24, which removes contaminants from within the lubricating oil, is attached to the housing via an oil-passage-forming body 50 (described later).

By the way, in the shown embodiment, oil-passage-forming body 50, to which oil filter 24 is attached, is constructed separately from the housing 22, but oil-passage-forming body 50 may be configured integral with the housing 22.

As shown in FIG. 3, an air compressor 9 is installed on the intake-side sidewall 7 of oil pan upper 6 and arranged at the front side of the engine. Also, the intake-side sidewall of the oil pan upper is provided with a fastening flange 8, to which a transmission is fixedly connected and which is located at the rear side of the engine. Oil cooler 23, oil-passage-forming body 50 to which oil filter 24 is attached, housing 22 in which speed reducer 21 is housed, and motor 20 are placed along the fore-and-aft direction of the engine and arranged between the fastening flange 8 and the air compressor 9. That is, on one hand, oil cooler 23 is placed in front of a side face of housing 22, facing the front side of the engine, in a manner so as to sandwich the oil-passage-forming body 50 between them. On the other hand, variable compression ratio motor 20 is placed in rear of a side face of housing 22, facing the rear side of the engine. A mounting flange 25 of housing 22 is fixed to the intake-side sidewall 7 of oil pan upper 6 by means of fixing bolts 26.

Figure 4:
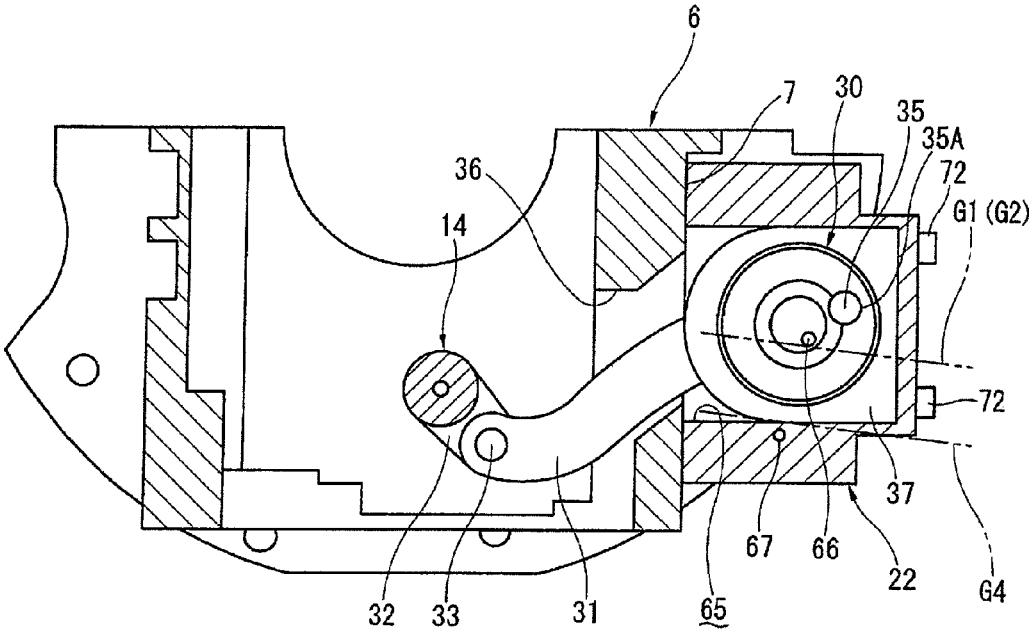
FIG. 4 is a cross-sectional view illustrating the internal combustion engine of the embodiment.

As shown in the drawings, in particular, FIGS. 2, 4, and 5, the control shaft 14, which is placed in the engine main body, and an auxiliary shaft 30, which is formed integral with the output shaft of speed reducer 21 placed in the housing 22, are connected together by means of a lever 31. By the way, in the embodiment, auxiliary shaft 30 is integrally formed with the output shaft of speed reducer 21. In lieu thereof, auxiliary shaft 30 may be configured separately from the output shaft of speed reducer 21 such that the auxiliary shaft and the speed-reducer output shaft rotate integrally with each other.

One end of lever 31 and the tip end of an arm 32 extending radially outward from the center of control shaft 14 as viewed in the axial direction are connected together via a third connecting pin 33 so as to permit relative rotation. The other end of lever 31 and auxiliary shaft 30 are connected together via a fourth connecting pin 35 so as to permit relative rotation. By the way, in FIGS. 2 and 5, the fourth connecting pin 35 is removed and omitted from FIGS. 2 and 5, and in lieu thereof a connecting-pin hole 35A, into which the fourth connecting pin 35 is fitted, is drawn. As shown in FIG. 4, a lever slit 36, into which lever 31 is inserted, is formed in the intake-side sidewall 7 of oil pan upper 6.

Figure 5A:
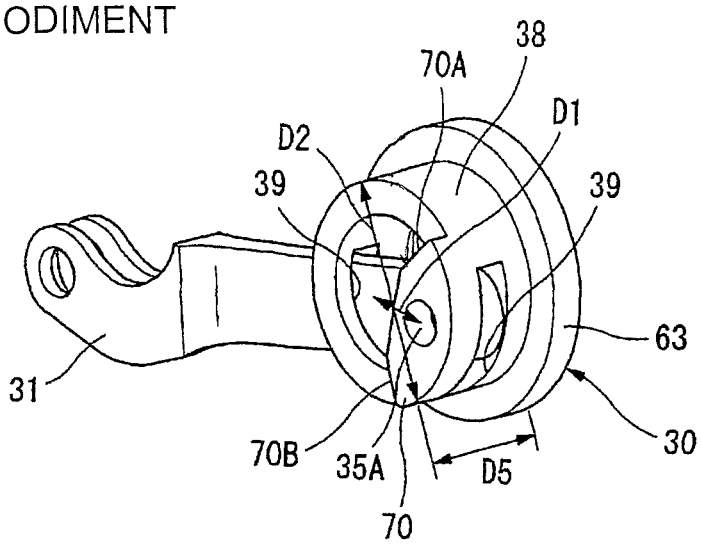

As shown in FIG. 5(A), in the auxiliary shaft 30 of the embodiment, an arm length D1, corresponding to the distance between the rotation center of auxiliary shaft 30 and the center of connecting-pin hole 35A into which the fourth connecting pin 35 is fitted, is set to be shorter than the radius (one-half the diameter D2) of a journal portion 38 rotatably supported by a metal bearing sleeve 37 (a bearing member) mounted on the housing 22, that is, $D1<(D2/2)$. Therefore, the fourth connecting pin 35 is located inside of the journal portion 38. That is, the journal portion 38 is configured to include the fourth connecting pin 35 inside thereof. By the way, a slit 39 for avoiding interference with the lever 31 is formed in the journal portion 38. In the embodiment, bearing sleeve 37 is configured as a metal integral part, but such a bearing sleeve may be constructed as a bearing member configured to have the same shape as the bearing sleeve 37 by fastening two separate parts, each of which has the same semi-cylindrical bearing surface, together with bolts.

Figure 5B:
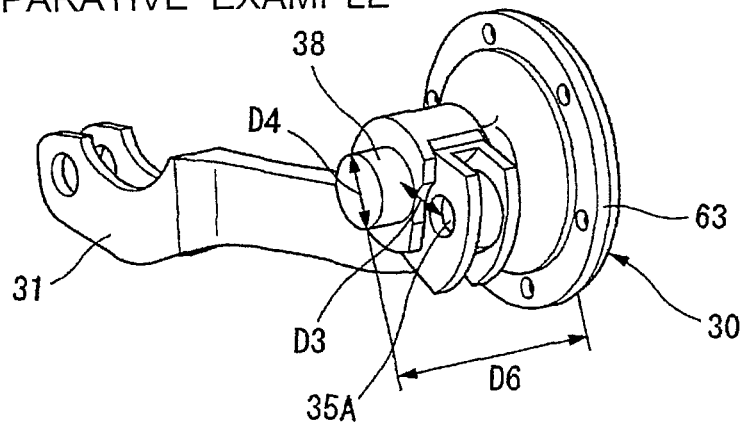
FIG. 5(B) is a perspective view illustrating an auxiliary shaft and lever sub-assembly of a comparative example.

On the other hand, in the auxiliary shaft 30 of the comparative example shown in FIG. 5(B), an arm length D3, corresponding to the distance between the rotation center of journal portion 38 and the center of connecting-pin hole 35A is set to be longer than the radius (one-half the diameter D4)

of the journal portion 38, that is, D3>(D4/2). That is, a portion of connecting-pin hole 35A is formed into an arm shape protruding radially outward with respect to the journal portion 38. Thus, it is necessary to lay out the journal portion 38 at a position, which is axially offset from the portion of connecting-pin hole 35A. Due to such an axial offset, an axial dimension D6 of auxiliary shaft 30 tends to increase.

In contrast to the comparative example, in the embodiment, it is possible to place the connecting-pin hole 35A inside of the journal portion 38, as discussed previously. Hence, it is unnecessary to lay out both the journal portion and the connecting-pin hole at separate axial positions. In comparison with the comparative example, it is possible to greatly shorten the axial dimension D5 of auxiliary shaft 30. Also, regarding the journal portion 38, for the purpose of ensuring a bearing strength, it is necessary to ensure a predetermined bearing surface area. However, in the case of the embodiment of FIG. 5(A) having the comparatively great diameter D2 of journal portion 38, it is possible to shorten the axial dimension of the journal portion 38 itself, while ensuring the same bearing surface area, in comparison with the comparative example of FIG. 5(B) having the comparatively small diameter D4 of journal portion 38. In this manner, by virtue of the shortened axial dimension of auxiliary shaft 30, it is possible to shorten the axial dimension of housing 22 in which the auxiliary shaft 30, together with the speed reducer 21, can be housed. For this reason, as shown in FIG. 3, in particular in the case of the mounting structure in which the oil cooler 23 in front of housing 22, the housing 22, and the motor 20 in rear of housing 22 are placed in series with each other along the fore-and-aft direction of the engine, it is possible to improve the mountability of the engine by shortening the considerably-limited longitudinal dimension in the fore-and-aft direction of the engine.

Figure 6:
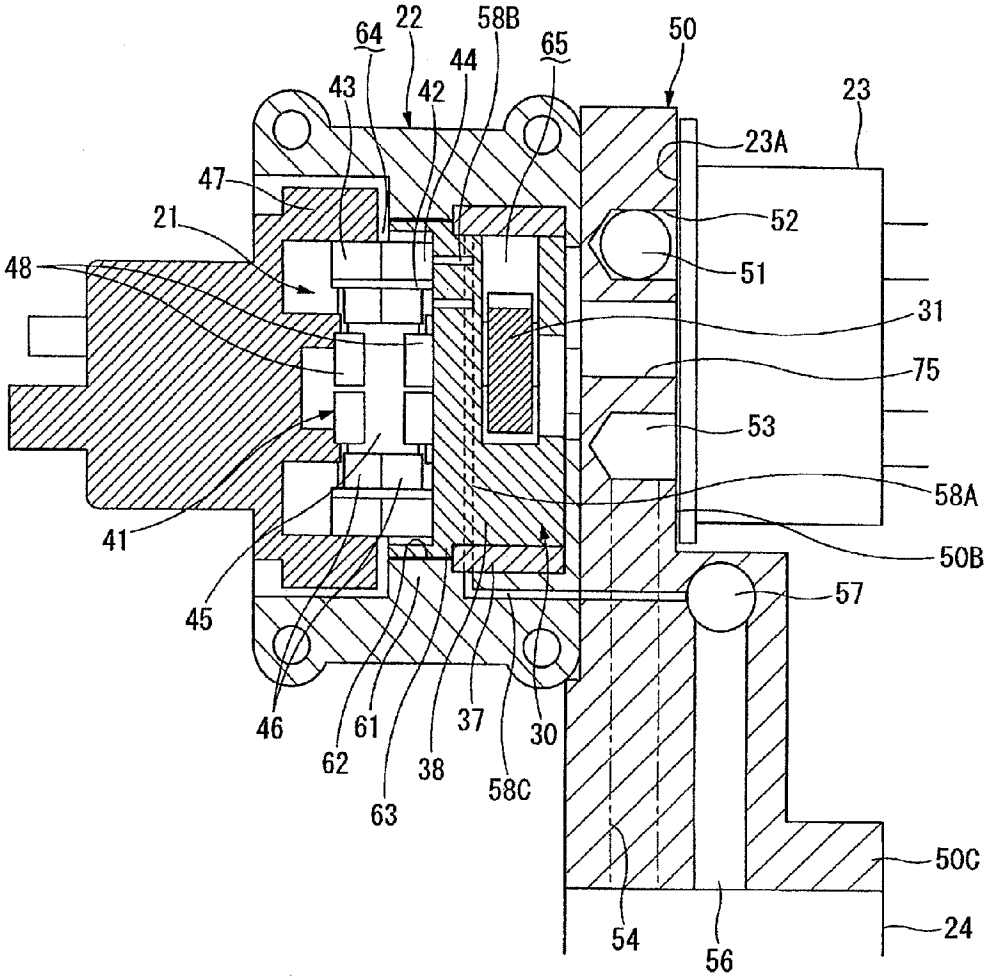
FIG. 6 is a cross-section in the vicinity of a housing of the embodiment.

The construction of speed reducer 21 is hereunder described in reference to FIG. 6. This speed reducer 21 utilizes a well-known harmonic drive mechanism. The speed reducer is comprised of four major component parts, namely, a wave generator 41, a flexspline 42 arranged around the circumference of wave generator 41, a circular spline 43 and a circular spline 44, both circular splines being juxtaposed to each other and arranged around the circumference of the flexspline.

Regarding wave generator 41, double-row ball bearings 46 are fitted onto the circumference of an ellipse-shaped cam 45 of the wave generator. Elastic deformation of the outer ring of each ball bearing 46 occurs depending on rotary motion of elliptical cam 45, the position of the major axis of the elliptical cam wave generator is displaced in the rotation direction. Flexspline 42 is a thin-walled, ring-shaped, elastic (flexible) metal part formed with external teeth cut on its outer periphery. On one hand, circular spline 44 is formed on its inner periphery with internal teeth of the same number of teeth as the flexspline 42. The circular spline rotates at the same speed as the flexspline 42 by a gear mesh of the circular spline with the flexspline 42, elastically deformed into an elliptical shape, at two engagement points along the major axis of the ellipse. On the other hand, another circular spline 43 is formed on its inner periphery with two fewer internal teeth than the number of external teeth on the flexspline 42. Similarly, a gear mesh of this circular spline with the flexspline 42 occurs at two engagement points along the major axis of the ellipse.

Wave generator 41 is fixed to the input shaft of speed reducer 21, which rotates integrally with the rotation axis of variable compression ratio motor 20. Circular spline 44 is fixed to the auxiliary shaft 30, serving as the output shaft of speed reducer 21. Circular spline 43 is fixed to a motor cover 47, which is fixed to the housing 22. Hence, rotation of the input shaft of speed reducer 21 is reduced at a predetermined reduction ratio, and then the reduced rotation is transmitted to the output-shaft side. By the way, reference sign 48 denotes each ball bearing for rotatably supporting the elliptical cam 45 fixed to the input shaft of speed reducer 21.

By the way, speed reducer 21 is not limited to a harmonic-drive speed reducer as described by reference to the embodiment, but another type speed reducer, such as a cycloid planetary-gear speed reducer or the like, may be utilized as the speed reducer 21.

A lubrication structure for speed reducer 21 is hereunder described.

As shown in FIG. 3, the oil-passage-forming body 50 is interposed between the side face of housing 22, facing the front side of the engine, and a side face of oil cooler 23, facing the rear side of the engine. An oil filter 24, in which a filter element is stored, is mounted on a filter mounting flange 50C (see FIGS. 7-8) of the oil-passage-forming body. A plurality of oil passages 51-58 are formed in the oil-passage-forming body 50.

As shown in FIGS. 6, and 8-10, lubricating oil is supplied from the inside of the engine main body via a first oil passage 51 and a second oil passage 52 formed in the oil-passage-forming body 50 to the oil cooler 23. One end of the first oil passage 51 is opened at an engine-main-body mounting face 50A of oil-passage-forming body 50 fixed to the intake-side sidewall 7 of oil pan upper 6. The second oil passage 52 is configured to intersect with the first oil passage 51. One end of the second oil passage is opened at a cooler mounting face 50B onto which oil cooler 23 is fixed.

Lubricating oil, discharged from the oil cooler 23, is supplied into the oil filter 24 by way of a third oil passage 53 opened at the cooler mounting face 50B, a fourth oil passage 54 communicating with the third oil passage 53, and a fifth oil passage 55 communicating with the fourth oil passage 54 and formed in the filter mounting flange 50C so as to extend in the circumferential direction.

Lubricating oil, discharged from the oil filter 24 immediately after having been filter-purified, is returned to the inside of the engine main body by way of a sixth oil passage 56 whose one end is opened at the filter mounting flange 50C, and a seventh oil passage 57, which intersects with the sixth oil passage 56 and whose one end is opened at the engine-main-body mounting face 50A. By the way, a portion of lubricating oil, discharged from the oil filter 24 immediately after having been filter-purified, is supplied via a bypass oil passage 58 to lubricated parts configured in the housing 22.

Figure 13:
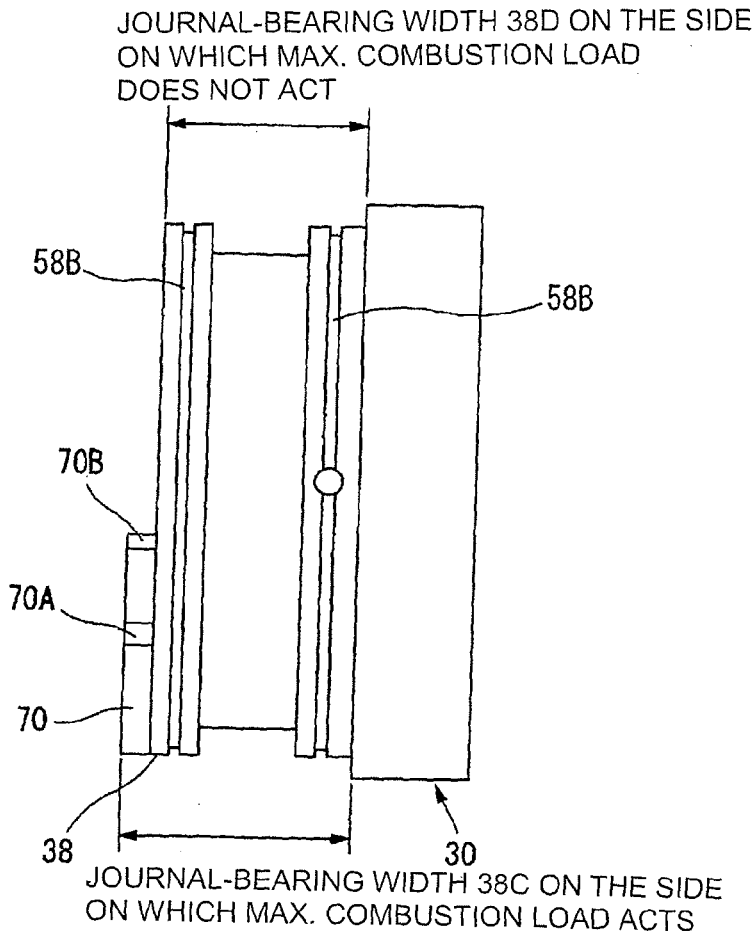
FIG. 13 is a side view illustrating a unitary structure of the auxiliary shaft of the embodiment.
Figure 14A:
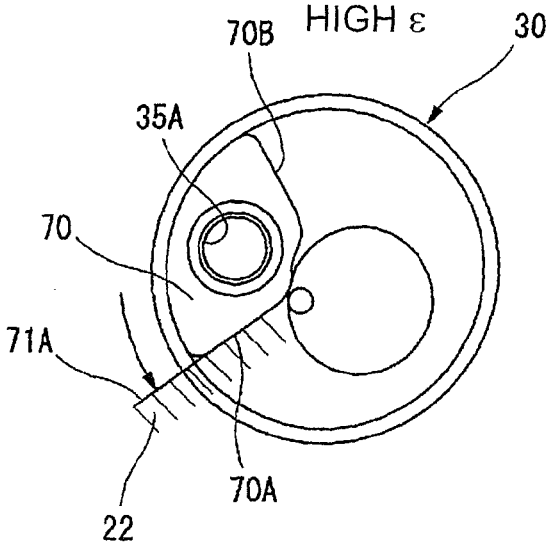
FIGS. 14(A)-14(B) are an explanatory views illustrating states of abutted-engagement of both side faces of a protruding portion of the auxiliary shaft with respective stopper faces of the housing.
Figure 14B:
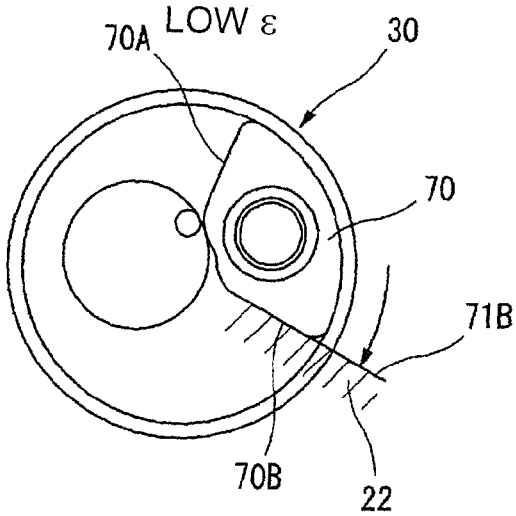
Figure 15:
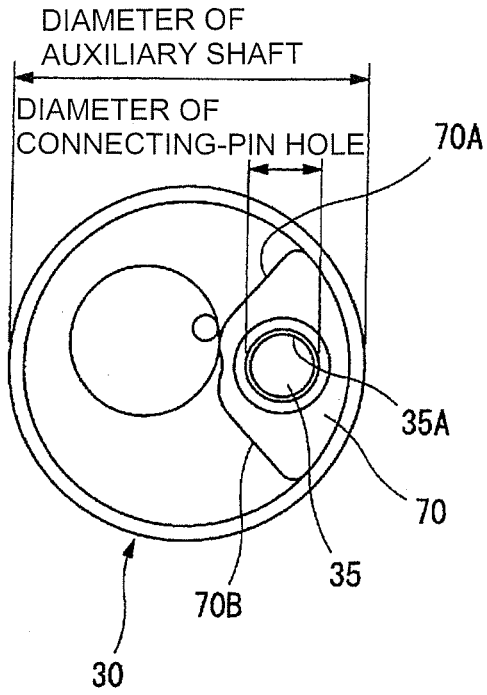
FIG. 15 is a front elevation view illustrating the auxiliary shaft of the embodiment.

As shown in the drawings, in particular, FIGS. 6, 11, and 13, bypass oil passage 58 is configured at one end to communicate with the seventh oil passage 57, and also configured to extend from the oil-passage-forming body 50 to the inside of housing 22. The bypass oil passage has a circumferential groove 58A formed in the circumference of the journal portion 38 of auxiliary shaft 30, a plurality of auxiliary oil passages 58B through which the circumferential groove 58A and a speed-reducer accommodation chamber 64 are communicated with each other, and a communication oil passage 58C through which the seventh oil passage 57 and the circumferential groove 58 are communicated with each other. Hence, by way of the aforementioned bypass oil passage 58, lubricating oil, passed through the oil filter 24 immediately after having been filter-purified, is supplied to the bearing surface of journal portion 38 as well as lubricated parts of speed reducer 21 accommodated in the housing 22, concretely, the meshed-engagement portions between flexspline 42 and each of circular splines 43-44, bearing surfaces of ball bearings 46 and 48, and the like.

Figure 8:
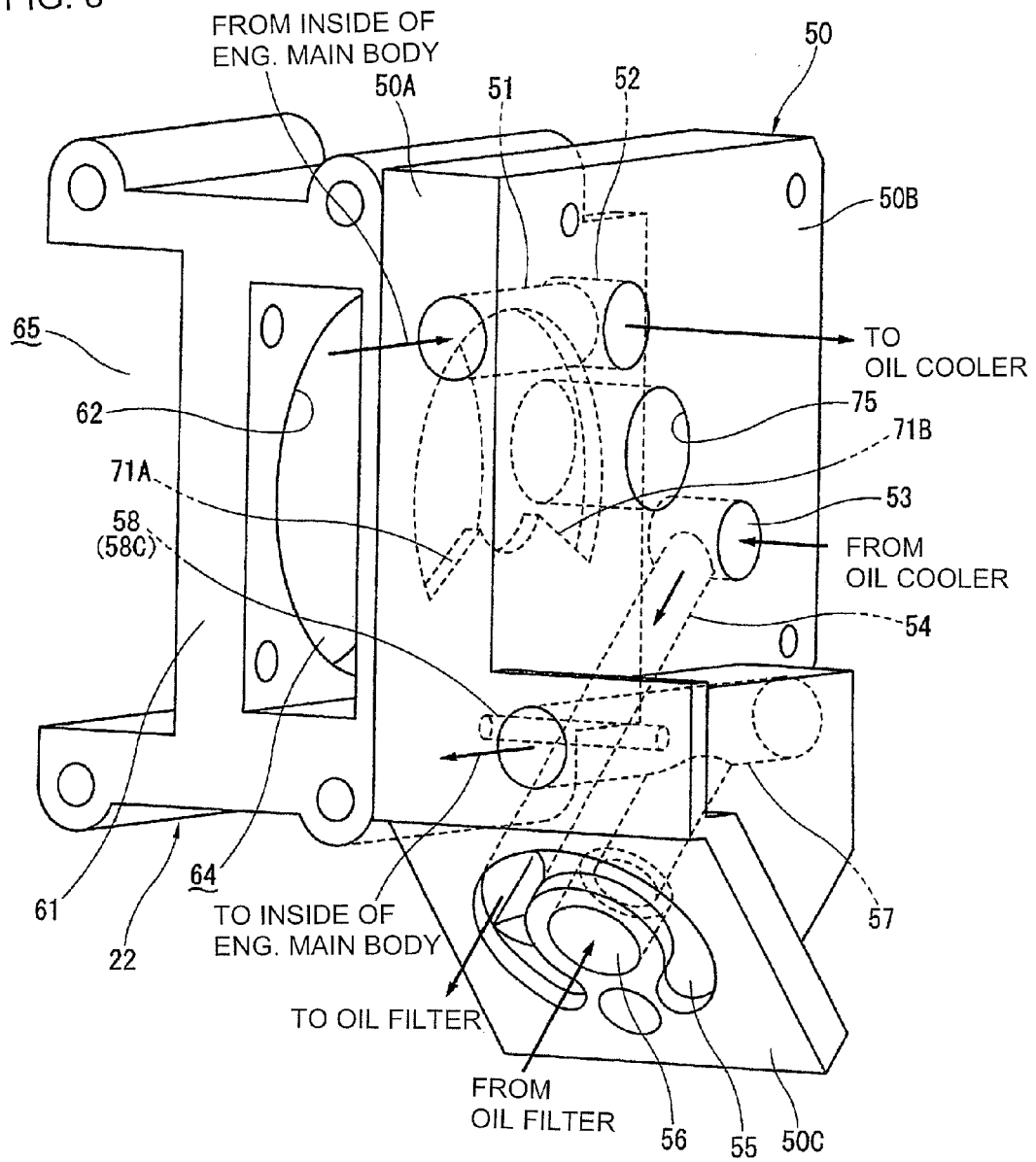
FIG. 8 is a perspective view illustrating the housing and an oil-passage-forming body in the embodiment.
Figure 9:
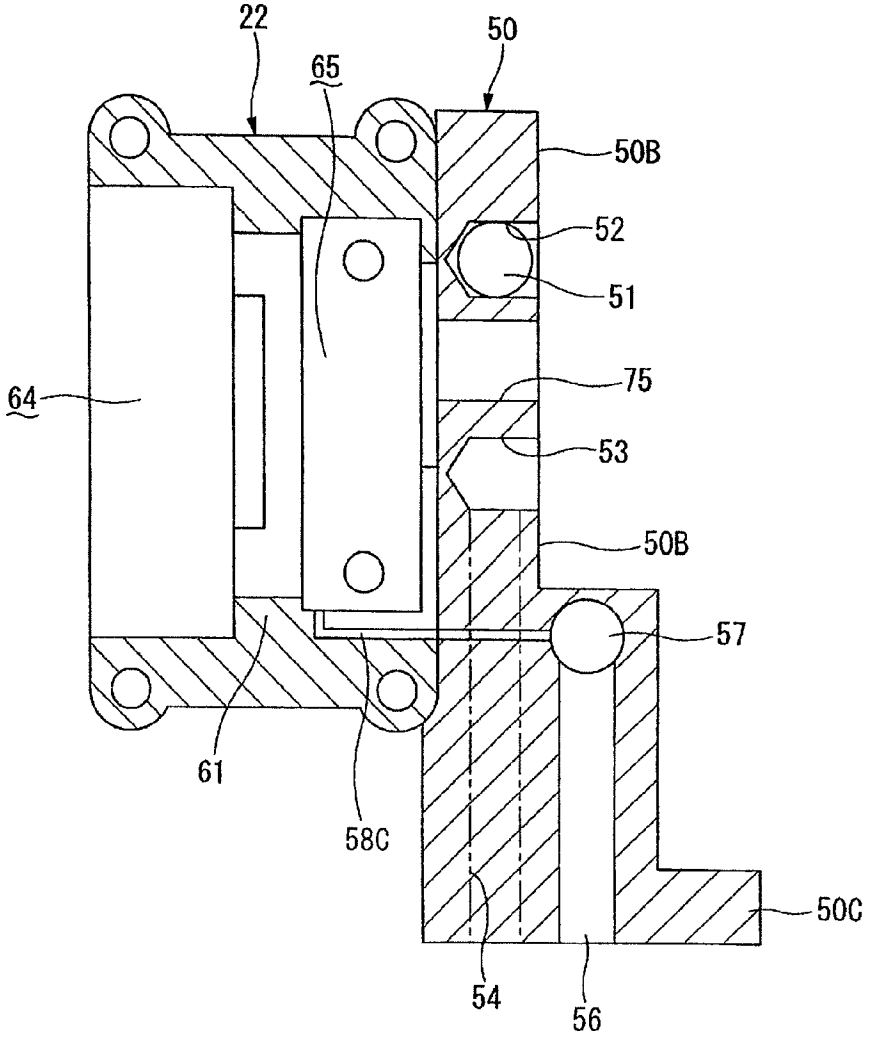
FIG. 9 is a cross-sectional view illustrating the housing and the oil-passage-forming body in the embodiment.
Figure 10:
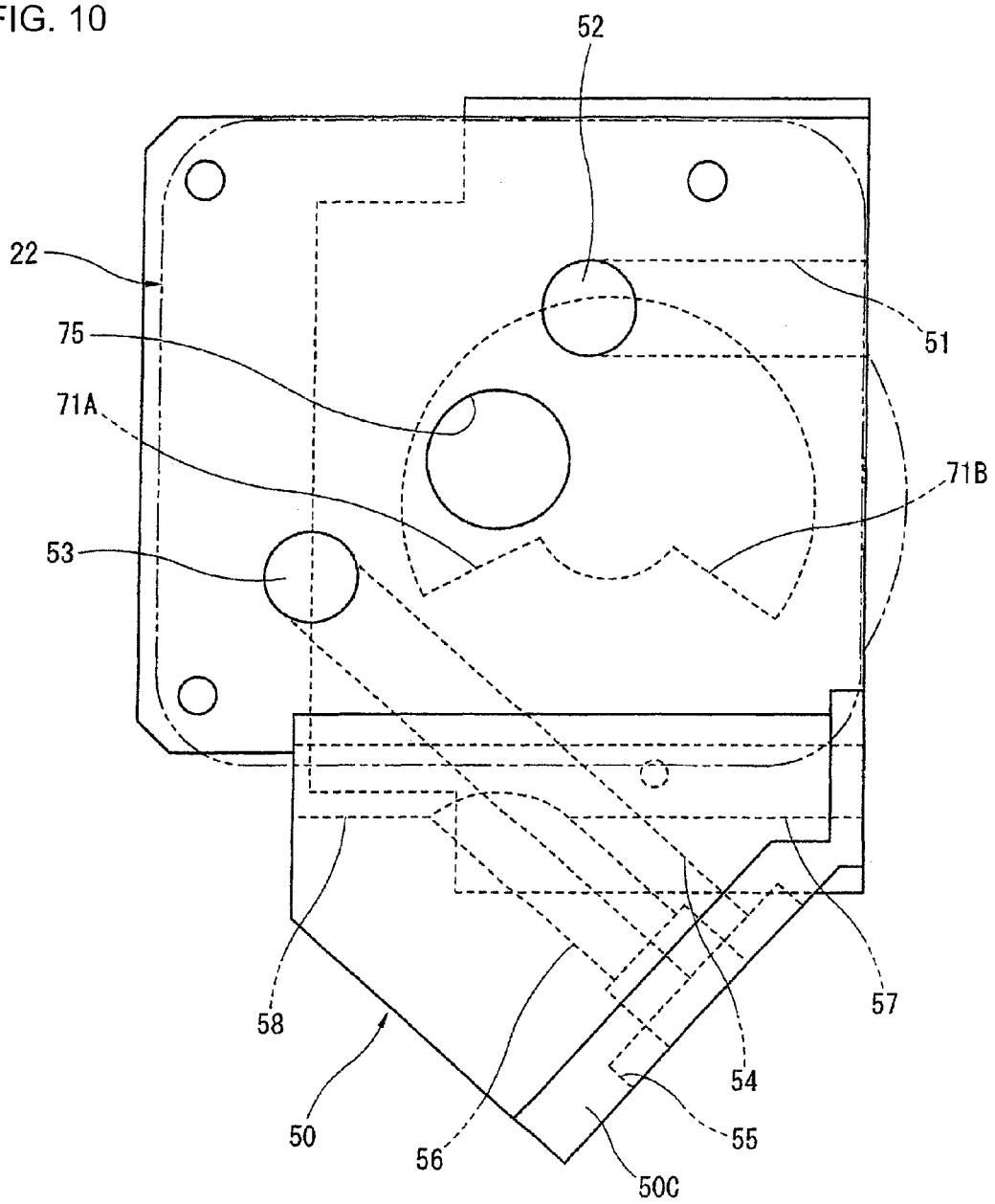
FIG. 10 is a plan view illustrating the housing and the oil-passage-forming body in the embodiment.

As shown in FIG. 8, the internal space of housing 22 is partitioned into the speed-reducer accommodation chamber 64 and an auxiliary-shaft accommodation chamber 65 by means of a partition wall portion 61 provided inside of the housing 22 and a large-diameter portion 63 of auxiliary shaft 30, which is rotatably loosely fitted through a slight clearance into a circular through opening 62 formed in the center of partition wall portion 61. As discussed previously, the major component parts of speed reducer 21, namely, wave generator 41, flexspline 42, circular spline 43 and circular spline 44, and their lubricated parts are placed in the speed-reducer accommodation chamber. The major part of auxiliary shaft 30 is placed in the auxiliary-shaft accommodation chamber. Also, the auxiliary-shaft accommodation chamber is configured to face the lever slit 36 (see FIG. 4) into which lever 31, connected with the auxiliary shaft 30, is inserted. Lubricating oil is supplied via the bypass oil passage 58 into the speed-reducer accommodation chamber 64. Then, the lubricating oil, stored in the speed-reducer accommodation chamber 64, is supplied via an oil hole 66 (described later) and the like into the auxiliary-shaft accommodation chamber 65. Thereafter, the lubricating oil, stored in the auxiliary-shaft accommodation chamber 65, is returned back to the inside of oil pan upper 6 (the engine main body) via the previously-noted lever slit 36.

In the embodiment shown and described herein, the oil hole 66 (see FIGS. 4 and 11), through which speed-reducer accommodation chamber 64 and auxiliary-shaft accommodation chamber 65 are communicated with each other, is formed as a through hole that penetrates the large-diameter portion 63 (the rotating body) of auxiliary shaft 30 that partitions the interior space of housing 22 into the speed-reducer accommodation chamber 64 and the auxiliary-shaft accommodation chamber 65. That is, oil hole 66 is formed in the large-diameter portion 63 constructing a part of the wall surface of speed-reducer accommodation chamber 64. As shown in FIGS. 4 and 11, oil hole 66 is located at a given position radially spaced apart from the rotation center of large-diameter portion 63. The level (the height position) of the oil hole changes depending on the rotational position of auxiliary shaft 30 that rotates in synchronism with rotation of control shaft 14. By the way, as shown in the drawings, in particular, FIGS. 5 and 11, regarding the auxiliary shaft 30, the radial dimension of large-diameter portion 63 is dimensioned to be greater than that of journal portion 38.

Additionally, as shown in FIGS. 4 and 11, an auxiliary oil hole 67 is formed in the bottom wall of housing 22. Speed-reducer accommodation chamber 64 and auxiliary-shaft accommodation chamber 65 (or the inside of the engine main body) are communicated with each other via the auxiliary oil hole, in a similar manner to the previously-noted oil hole 66. The auxiliary oil hole 67 is dimensioned and configured as an orifice passageway having a smaller inside diameter and a smaller opening area than the previously-noted oil hole 66. The auxiliary oil hole is located at a given position lower than the oil hole 66 in the vertical direction, concretely, arranged at the lowermost end of housing 22.

Figure 11A:
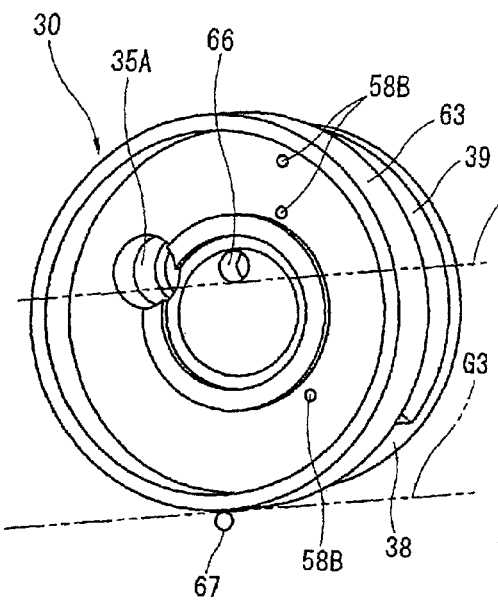
Figure 11B:
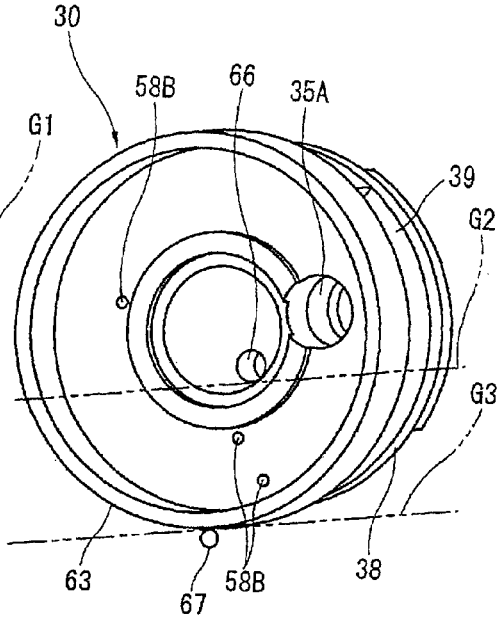
FIG. 11(B) is an explanatory view illustrating an oil-level height position of the auxiliary shaft at a high compression ratio.

FIG. 11 shows the position (the level) of the oil hole 66 depending on a rotational position of auxiliary shaft 30 (that is, a state of setting of the engine compression ratio). FIG. 11(A) shows a state of setting of a low compression ratio, used in a high-temperature high-load range, whereas FIG. 11(B) shows a state of setting of a high compression ratio, used in a low-temperature low-load range. Two-dotted lines G1-G3 indicated in these drawings represent respective oil-level heights. That is, these two-dotted lines G1-G3 correspond to respective oil-level horizontal lines parallel to each other in the horizontal direction under a state where the actuator has been mounted on the vehicle.

Under a condition where the engine is operating, lubricating oil is always supplied to the speed-reducer accommodation chamber 64 via the bypass oil passage 58. Thus, a slight amount of lubricating oil tends to flow out from the speed-reducer accommodation chamber 64 through the auxiliary oil hole 67 and the like, but most of the lubricating oil flows from the speed-reducer accommodation chamber 64 through the oil hole 66 into the auxiliary-shaft accommodation chamber 65. Therefore, the respective oil-level height positions G1, G2 of lubricating oil, stored in the speed-reducer accommodation chamber 64, become near the lowermost end of oil hole 66. In the embodiment, during a low compression ratio setting shown in FIG. 11(A), the position of oil hole 66 is higher than that of a high compression ratio setting shown in FIG. 11(B). The position of oil hole 66 is set such that the oil-level height position G1 within the speed-reducer accommodation chamber 64 during a low compression ratio becomes higher than the oil-level height position G2 within the speed-reducer accommodation chamber 64 during a high compression ratio.

Therefore, in a state of setting of a low compression ratio, used in a high-temperature high-load range, by raising the oil-level height position G1 within the speed-reducer accommodation chamber 64 and by increasing the amount of lubricating oil in the speed-reducer accommodation chamber 64, it is possible to improve the lubricating performance and the cooling performance of speed reducer 21 in a high-temperature high-load range, thus enhancing both the durability and the reliability. On the other hand, in a state of setting of a high compression ratio, used in a low-temperature low-load range, by relatively lowering the oil-level height position G2 within the speed-reducer accommodation chamber 64 and by reducing the amount of lubricating oil in the speed-reducer accommodation chamber 64, it is possible to reduce a resistance to oil agitation, occurring owing to rotation of speed reducer 21. For the reasons discussed above, for instance during acceleration with an engine load increase, the engine compression ratio has to be rapidly reduced from a high compression ratio (e.g., approximately 14) to a middle compression ratio (e.g., approximately 12) needed for knocking avoidance, but, according to the embodiment, it is possible to reduce the resistance to oil agitation, occurring owing to rotation of speed reducer 21, by adjusting the oil-level height position G2 to a relatively lower level. For instance, the response time to a compression ratio decrease can be shortened by several ten milliseconds. In this manner, by improving the response to a compression ratio decrease from a high compression ratio to a low compression ratio, it is possible to alleviate a limit for knocking avoidance to a compression ratio change to high compression ratios. Hence, it is possible to improve fuel economy by virtue of a compression ratio change to high compression ratios.

Additionally, in the embodiment, such an oil-level height adjustment based on the engine compression ratio is realized by forming the oil hole 66 in the auxiliary shaft 30, serving as a rotating body that rotates in synchronism with rotation of control shaft 14, and thus it is possible to provide the previously-discussed operation and effects by a simple construction.

In the case that a negative pressure occurs in the variable compression ratio motor 20 owing to a fall in internal temperature in the motor 20 on the assumption that the oil-level height within the housing 22 is a position higher than a seal part of the motor input shaft of variable compression ratio motor 20, lubricating oil is sucked from the seal part of the motor input shaft into the inside of the motor and thus there is a possibility for oil to enter into the inside of the motor. Therefore, in the embodiment, the oil-level height positions G1, G2 based on the engine operating condition are set at positions further lower than the lower end of the seal part of the motor input shaft of variable compression ratio motor 20. Hence, it is possible to suppress or avoid oil from entering the inside of the motor.

When the engine has stopped running, lubricating oil is gradually drained from the speed-reducer accommodation chamber 64 via the auxiliary oil hole 67 having a smaller flow passage area, and then returned via the lever slit 36, facing the auxiliary-shaft accommodation chamber 65, back to the inside of the engine main body. Therefore, as shown in FIG. 11, the oil-level height position G3 within the speed-reducer accommodation chamber 65 during a stop of the engine tends to become near the lowermost end of housing 22 in the vicinity of the auxiliary oil hole 67, irrespective of the engine compression ratio setting. Also, as shown in FIG. 4, an oil-level height position G4 within the auxiliary-shaft accommodation chamber 65 becomes near the lowermost end of housing 22. Hence, housing 22 comes to a state where most of lubricating oil in the housing has been drained.

When the engine has stopped running, foreign matter, such as iron, aluminum and the like, existing in the lubricating oil, becomes deposited on the bottom of housing 22, but, according to the embodiment, it is possible to drain the foreign matter or contaminants deposited on the bottom of housing 22, together with the lubricating oil, by forming the auxiliary oil hole 67 in the bottom of housing 22, thus suppressing wear of speed reducer 21. Additionally, during the maintenance, such as during disassembling or assembling of the speed reducer 21 and/or the variable compression ratio motor 20, housing 22 has been brought into a state where lubricating oil has already been drained out from within the housing. Thus, it is possible to suppress an oil leakage or the like during the maintenance. This is superior in maintainability.

The construction, operation and effects, peculiar to the shown embodiment, are hereunder enumerated.

[1] As shown in the drawings, in particular, FIGS. 2, 3, and 6, oil filter 24 is attached via the oil-passage-forming body 50 to the housing 22, in which speed reducer 21 is housed. Additionally, bypass oil passage 58, which supplies a portion of lubricating oil passed through the oil filter 24 immediately after having been filter-purified to lubricated parts of speed reducer 21 placed in the speed-reducer accommodation chamber 64 of housing 22, is provided. Therefore, it is possible to feed the lubricating oil, immediately after having been purified by means of the oil filter 24, through the use of the shortest route via the bypass oil passage 58 to the lubricated parts of speed reducer 21, thereby minimizing mixing/entry of foreign matter (debris/contaminants) into the speed-reducer accommodation chamber 64, and thus increasing the reliability and durability of the speed reducer.

[2] As shown in the drawings, in particular, FIGS. 2 and 3, housing 22, in which variable compression ratio motor 20 and speed reducer 21 are housed, is attached to the intake-side sidewall 7 of oil pan upper 6, constructing a part of the engine main body, for the purpose of protecting them against exhaust heat.

[3] However, in the case that housing 22 and the like are arranged on the intake-side sidewall 7 as discussed above, as shown in FIG. 3, the respective component parts have to be installed in a limited space sandwiched between the air compressor 9 arranged at the front side of the engine and the fastening flange 8 to which the transmission is fixedly connected and which is located at the rear side of the engine, and thus a limitation on the longitudinal dimension in the fore-and-aft direction of the engine becomes severe. Also, from the relevance to the layout of an oil pump and a main oil gallery on the intake-side sidewall 7 of cylinder block 1 above the oil pan upper 6, oil cooler 23 and oil filter 24 have to be arranged on the intake side. Thus, it is more difficult to ensure the mounting space.

For the reasons discussed above, in the embodiment, oil cooler 23, which cools the lubricating oil, together with the oil filter 24, is attached to the housing 22. Thus, oil cooler 23 and oil filter 24 are gathered around the housing 22, and thus it is possible to improve the mountability of the engine, thus realizing simplification and shortening of the oil passages.

[4] Concretely, oil cooler 23 is fixedly connected to the housing 22 with the oil-passage-forming body 50, whose thickness is thinner than the oil filter 24, therebetween. Oil filter 24 is attached to the oil-passage-forming body 50. Additionally, oil passages 51-58, through which the lubricating oil flows, are formed in the oil-passage-forming body. Therefore, in addition to the operation and effect of the above-mentioned item [3], by virtue of offset arrangement of the oil filter 24 at a position, which is offset from the oil cooler 23, the oil-passage-forming body 50, and the housing 22, all placed in series with each other in the fore-and-aft direction of the engine, it is possible to shorten the longitudinal dimension in the fore-and-aft direction of the engine, thus improving the mountability of the engine.

[5] Formed in the oil-passage-forming body 50 are oil passages 51-52, which supply the lubricating oil from the engine main body to the oil cooler 23, oil passages 53, 54, and 55, which supply the lubricating oil from the oil cooler 23 to the oil filter 24, oil passages 56-57, which supply the lubricating oil from the oil filter 24 to the engine main body, and bypass oil passage 58, which supplies the lubricating oil from the oil filter 24 to the lubricated parts of the speed reducer. In this manner, the oil passages, which are provided for respectively supplying the lubricating oil to the oil cooler 23, the oil filter 24, and the lubricated parts of speed reducer 21, are concentrated at the oil-passage-forming body 50, and thus it is possible to realize shortening of the oil passages and compactification of the device/system.

[6] Also, as shown in FIG. 4, control shaft 14, which is placed in the engine main body, and auxiliary shaft 30, which is rotatably supported in the housing 22 and rotates integrally with the output shaft of speed reducer 21, are connected together by means of the lever 31, which is inserted through the lever slit 36 formed in the sidewall 7 of the engine main body. One end of lever 31 and auxiliary shaft 30 are connected together by the fourth connecting pin 35 so as to permit relative rotation.

By the way, assume that, for the purpose of the previously-discussed demand for shortening of the longitudinal dimension in the fore-and-aft direction of the engine, the axial dimension of auxiliary shaft 30 is simply shortened. In such a case, the width of the bearing surface of the journal portion 38 of auxiliary shaft 30, which is rotatably supported in the housing 22, becomes shortened, and thus the bearing surface pressure tends to increase, and as a result there is a possibility for wear to develop. Therefore, in the embodiment, as shown in FIG. 5(A), connecting-pin hole 35A, into which the connecting pin is inserted, is configured to be located inside of the journal portion 38. That is, the arm length D1 between the center of journal portion 38 and the center of connecting-pin hole 35A is set to be shorter than the radius (D2/2) of journal portion 38, and thus the journal portion 38 is configured to include the connecting-pin hole 35A inside thereof. Hence, it is possible to suppress or reduce the axial dimension D5 of auxiliary shaft 30, while ensuring a bearing surface area by enlarging the radial dimension of journal portion 38, thus improving the mountability of the engine.

[7] Concretely, as shown in FIG. 5(A), the axial dimension D5 of auxiliary shaft 30 containing the journal portion 38, is set to be shorter than the radial dimension (i.e., the diameter) D2 of journal portion 38. Thus, it is possible to provide the sufficiently shortened axial dimension.

Figure 12:
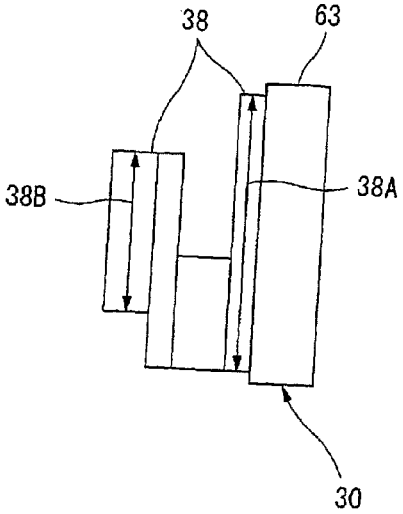
FIG. 12 is a side view of the auxiliary shaft, whose journal portion including two different journal sections having respective outside diameters differing from each other as viewed from the axial direction.

[8] In a modification shown in FIG. 12, the radial dimension (i.e., the diameter) 38A of an actuator-side journal section of journal portion 38 is set to be greater than the radial dimension (i.e., the diameter) 38B of an anti-actuator-side journal section. The actuator-side journal section, on which motor 20 and speed reducer 21 are installed, tends to oscillate, since motor 20 as well as speed reducer 21 serves as a vibrating weight. Therefore, the input load of the actuator-side journal section tends to become greater than that of the anti-actuator-side journal section. For the reasons discussed above, it is possible to effectively reduce the bearing surface pressure by setting the dimension (i.e., the diameter) 38A of the actuator-side journal section to be relatively greater than the anti-actuator-side.

[9] As shown in FIG. 13, a partially axially protruding portion 70 is provided at a part of journal portion 38 on which the maximum combustion load acts. Hence, an axial dimension 38C of this part is set to be greater than an axial dimension 38D of a part of the journal portion on which the maximum combustion load does not act. Thus, by virtue of the increased bearing surface area of the journal on which the maximum combustion load acts, it is possible to effectively reduce the bearing surface pressure.

[10] As shown in FIGS. 5(A), 13, and 14(A)-14(B), journal portion 38 is provided with the partially axially protruding sector portion 70 located at the portion of connecting-pin hole 35A. Additionally, both circumferential side faces 70A, 70B of the protruding portion 70 are configured to permit abutted-engagement with respective stopper faces 71A, 71B formed at the side of housing 22.

Therefore, it is possible to mechanically limit the range of rotation of control shaft 14, that is, the variable range of the engine compression ratio by limiting the movable range of auxiliary shaft 30 within a given range determined by abutted-engagement of both side faces 70A, 70B with respective stopper faces 71A, 71B. Additionally, part of the maximum combustion load can be received by the abutting portions of these two components, and thus it is possible to reduce the maximum bearing pressure acting on the bearing surface. Also, the axial dimension of the protruding portion 70, at which connecting-pin hole 35A is placed, becomes increased, and thus the rigidity of the bearing area of connecting-pin hole 35A can be enhanced. Furthermore, a snap-ring groove, into which a connecting-pin anti-loose snap ring is fitted, can be easily formed in the protruding portion 70 without increasing the axial dimension.

Figure 7:
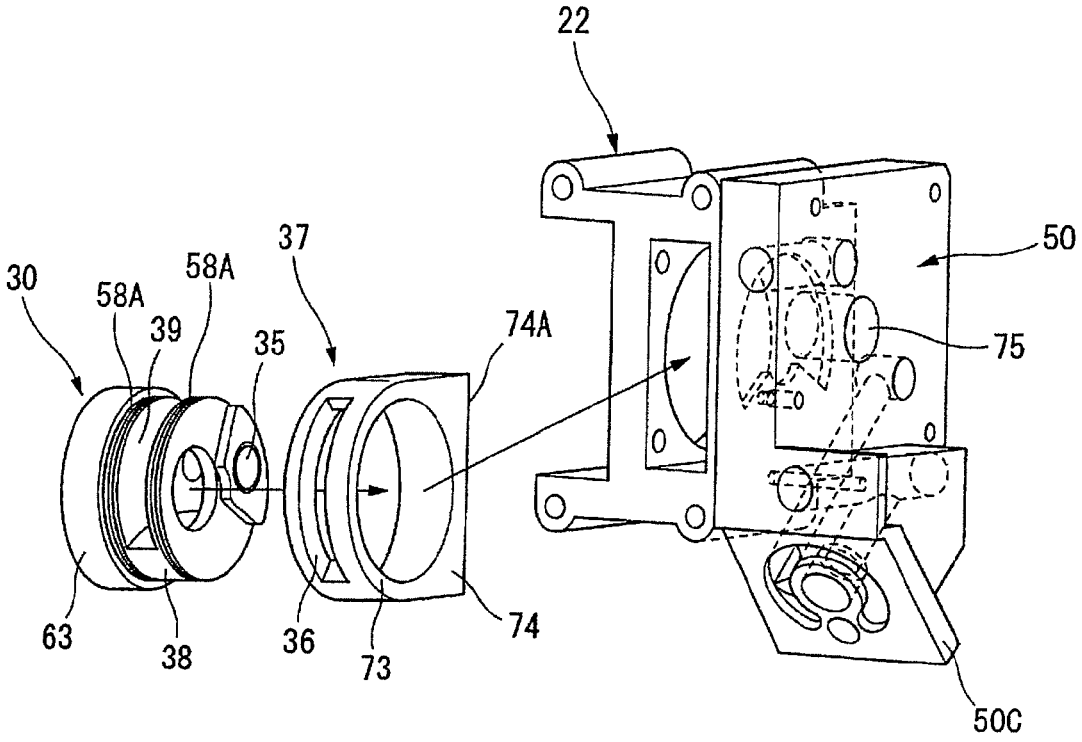
FIG. 7 is a disassembled perspective view illustrating the auxiliary shaft, a bearing sleeve (a bearing member), and the housing of the embodiment.
Figure 16:
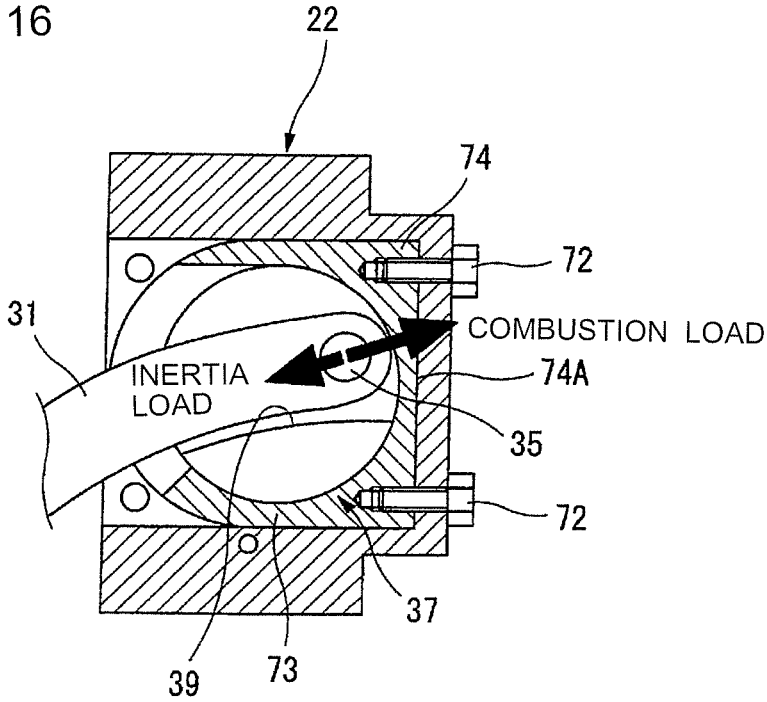
FIG. 16 is a cross-sectional view illustrating the assembled section of the bearing sleeve and the housing in the embodiment.

[11] As shown in the drawings, in particular, FIGS. 4, 7, and 16, bearing sleeve 37, which rotatably supports the journal portion 38 of auxiliary shaft 30, is formed separately from the housing 22. The bearing sleeve is configured to be fixed to the housing 22 with two bolts 72. The difference in the coefficient of thermal expansion between the auxiliary shaft 30 and the bearing sleeve 37 is set to be less than the difference in the coefficient of thermal expansion between the bearing sleeve 37 and the housing 22. For instance, in the case that the material of housing 22 is aluminum, the material of bearing sleeve 37 is iron, and the material of auxiliary shaft 30 is iron, the difference in the coefficient of thermal expansion between the auxiliary shaft 30 and the bearing sleeve 37 can be decreased, and hence it is possible to suppress a clearance change of the bearing area occurring owing to the thermal expansion. Therefore, it is possible to suppress a deterioration in noise/vibration performance owing to a clearance increase of the bearing area. Also, it is possible to suppress an increase in friction, occurring owing to an excessive decrease in clearance.

[12] As shown in FIGS. 7 and 16, bearing sleeve 37 is comprised of a cylindrical portion 73 that rotatably supports the journal portion 38 of auxiliary shaft 30, and a mounting base 74 having a housing-mounting flat face 74A that is fitted or fixed onto one sidewall of housing 22 with the two bolts 72. The cylindrical portion and the mounting base are integrally molded or formed of an iron material. The cylindrical portion 73 is formed with the slit 36 through which the lever 31 is inserted.

As shown in FIG. 16, the bearing sleeve 37 is set or configured such that the maximum combustion load acts on a given part (a given position) of the inner circumferential surface positioned on the side of the mounting base 74 of bearing sleeve 37 and sandwiched between the two bolts 72. Thus, it is possible to suppress the force acting in the direction of the opening, facing apart from the bolting face, by fastening the bearing sleeve with the bolts on the side of the bearing sleeve on which the maximum combustion load acts. This is because the tensile load (the inertia load), produced by the inertia force acting on the bolt 72, is comparatively smaller, that is, approximately 50% of the combustion load. The load is distributed through the bearing sleeve 37 formed of iron having a rigidity higher than aluminum into the light-weight housing 22 formed of aluminum, and thus it is possible to suppress the deformation of the aluminum housing 22. Accordingly, it is possible to suppress fluctuations in the engine combustion ratio.

Figure 17A:
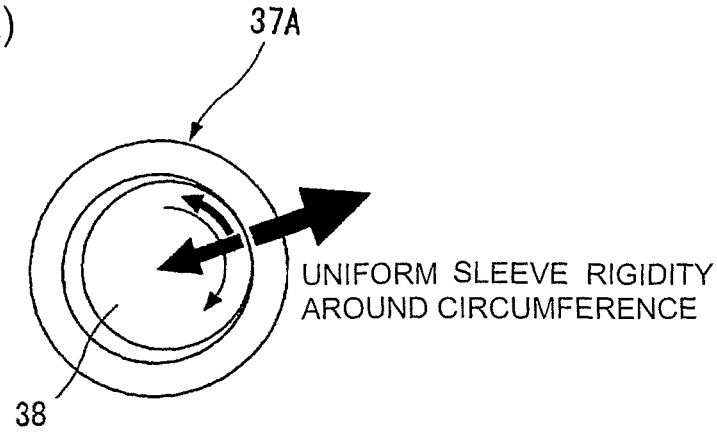
Figure 17B:
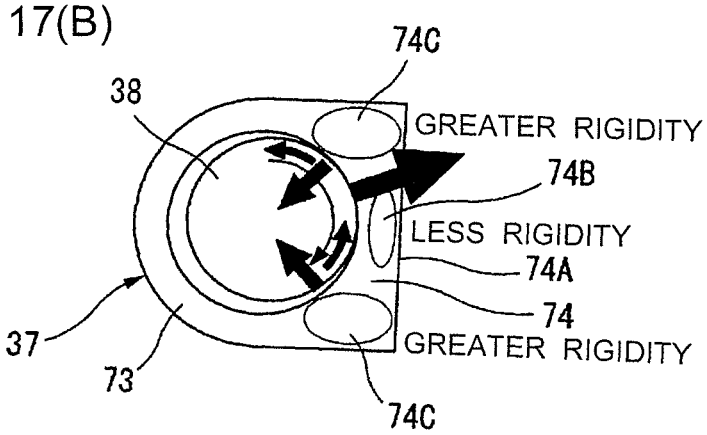
FIG. 17(B) is an explanatory view illustrating the bearing sleeve of the embodiment.

[13] FIG. 17(A) shows a bearing sleeve 37A of the reference example, which is formed into a cylindrical shape, and whose bearing thickness is uniform around the entire circumference. In contrast, as shown in FIG. 17(B), in the embodiment, the rigidity of a thin-walled central portion 743 of the mounting base 74 of bearing sleeve 37, on which the maximum combustion load acts, is set to be less than the rigidity of thick-walled both-side bolted portions 74C through which the bearing sleeve is fastened with the two bolts. Hence, when the combustion load acts, the greatest contact portions with the bearing sleeve 37 become two points near the previously-noted bolted portions of bearing sleeve 37. In this manner, the bearing sleeve is configured such that the load is supported mainly by these two points, and thus the friction tends to increase approximately 1 to 1.4 times greater than the reference example of FIG. 17(A) in which the maximum combustion load is supported by one point. Therefore, when the maximum combustion load acts, by virtue of the increased friction, it is possible to reduce the holding torque of control shaft 14.

On the other hand, when the combustion load is small, the amount of elastic deformation is also small. Thus, the strong contact tends to occur at one point on which the combustion load acts, in the same manner as the previously-discussed reference example. Hence, an increase in friction can be suppressed, and therefore it is possible to suppress a deterioration in the response to a compression ratio change, which may occur owing to such an increase in friction.

[14] As shown in FIGS. 6 to 10, a connecting-pin assembling window 75, facing the fourth connecting pin 35, is formed in the oil-passage-forming body 50 of oil filter 24 so as to penetrate the oil-passage-forming body. Therefore, when assembling, under a state where oil-passage-forming body 50 has been assembled on the housing 22 in advance as a unit, the housing 22 is bolted to the intake-side sidewall 7 of oil pan upper 6. After this, the fourth connecting pin is installed through the connecting-pin assembling window 75. In this manner, lever 31 and auxiliary shaft 30 can be connected together so as to permit relative rotation.

Thereafter, as shown in FIG. 6, oil cooler 23 is fixedly connected to the cooler mounting face 50B of oil-passage-forming body 50. As a result, oil passages 52, 53, which are opened at the cooler mounting face 50B of oil-passage-forming body 50, are communicated with respective oil passages (not shown), which are opened at a mounting face 23A of oil cooler 23, and at the same time the previously-discussed connecting-pin assembling window 75 is sealed by the mounting face 23A of oil cooler 23 in a fluid-tight fashion, thereby avoiding oil leakages from occurring.

The invention claimed is:

1. A variable compression ratio internal combustion engine having a variable compression ratio mechanism that utilizes a multi-link piston-crank mechanism having at least a lower link, and upper link, a control shaft, a control eccentric shaft, and a control link, the multi-link piston-crank mechanism configured to enable an engine compression ratio to be changed depending on a rotational position of the control shaft driven by an actuator, a speed reducer that reduces rotation of the actuator and transmits the reduced rotation to the control shaft, the actuator and the speed reducer being attached to a sidewall of an engine main body with a housing therebetween, comprising:

an oil filter attached to the housing for removing contaminants from within lubricating oil; and a bypass oil passage provided for supplying a portion of the lubricating oil after having passed through the oil filter to lubricated parts of the speed reducer installed in the housing.

2. A variable compression ratio internal combustion engine as recited in claim 1, wherein:

the housing is installed on an intake-side sidewall of the engine main body; and the actuator and the speed reducer are placed along a fore-and-aft direction of the engine.

3. A variable compression ratio internal combustion engine as recited in claim 1, wherein:

an oil cooler, which cools the lubricating oil, together with the oil filter, is attached to the housing.

4. A variable compression ratio internal combustion engine as recited in claim 3, wherein:

the oil filter is attached to an oil-passage-forming body, oil passages, through which the lubricating oil flows, being formed in the oil-passage-forming body;

the oil cooler is fixedly connected to the housing with the oil-passage-forming body therebetween.

5. A variable compression ratio internal combustion engine as recited in claim 4, wherein:

the oil passages, which supply the lubricating oil from the engine main body to the oil cooler, the oil passages, which supply the lubricating oil from the oil cooler to the oil filter, the oil passages, which supply the lubricating oil from the oil filter to the engine main body, and the bypass oil passage, which supplies the lubricating oil from the oil filter to the lubricated parts of the speed reducer, are all formed in the oil-passage-forming body.

6. A variable compression ratio internal combustion engine as recited in claim 4, further comprising:

an auxiliary shaft, which is rotatably supported in the housing and rotates integrally with an output shaft of the speed reducer;

a lever by which the control shaft and the auxiliary shaft are connected together; and a connecting pin by which one end of the lever and the auxiliary shaft are connected together so as to permit relative rotation, wherein the auxiliary shaft is provided with a journal portion rotatably supported in the housing and formed with a connecting-pin hole into which the connecting pin is inserted, and the connecting-pin hole is placed inside of the journal portion.

7. A variable compression ratio internal combustion engine as recited in claim 6, wherein:

an axial dimension of the journal portion of the auxiliary shaft is set to be shorter than a radial dimension of the journal portion.

8. A variable compression ratio internal combustion engine as recited in claim 6, wherein:

a radial dimension of an actuator-side journal section of the journal portion is set to he greater than a radial dimension of an anti-actuator-side journal section of the journal portion.

9. A variable compression ratio internal combustion engine as recited in claim 6, wherein:

an axial dimension of a part of the journal portion on which a maximum combustion load acts is set to be greater than an axial dimension of a part of the journal portion on which the maximum combustion load does not act.

10. A variable compression ratio internal combustion engine as recited in claim 9, further comprising:

a bearing member fixed to the housing for rotatably supporting the journal portion of the auxiliary shaft, wherein a difference in a coefficient of thermal expansion between the auxiliary shaft and the bearing member is set to be less than a difference in a coefficient of thermal expansion between the bearing member and the housing.

11. A variable compression ratio internal combustion engine as recited in claim 10, wherein:

the bearing member is fastened on one sidewall of the housing with at least two bolts; and the bearing member is configured such that the maximum combustion load acts on a given part of an inner circumferential surface of the bearing member sandwiched between the two bolt.

12. A variable compression ratio internal combustion engine as recited in claim 11, wherein:

a rigidity of a portion of the bearing member, on which the maximum combustion load acts, is set to be less than a rigidity of each bolted portion through which the bearing member is fastened with the two bolts.

13. A variable compression ratio internal combustion engine as recited in claim 6, wherein:

the journal portion is provided with a partially axially protruding sector portion; and both circumferential side faces of the protruding sector portion are configured to be brought into abutted-engagement with respective stopper faces formed at the housing.

14. A variable compression ratio internal combustion engine as recited in claim 6, wherein:

the oil filter is attached to the oil-passage-forming body, the oil passages, through which the lubricating oil flows, being formed in the oil-passage-forming body, and the oil cooler is fixedly connected to the housing with the oil-passage-forming body therebetween;

a connecting-pin assembling window, facing the connecting pin, is formed in the oil-passage-forming body so as to penetrate the oil-passage-forming body; and the oil-passage-forming body is configured such that one end of the oil-passage-forming body is sealed by a side face of the oil cooler under an assembled state.

* * * * *